US005761778A

United States Patent [19]

Fleissner

[11] Patent Number: 5,761,778

[45] Date of Patent: Jun. 9, 1998

[54] METHOD AND DEVICE FOR HYDRODYNAMIC ENTANGLEMENT OF THE FIBERS OF A FIBER WEB

[75] Inventor: Gerold Fleissner, Zug, Switzerland

[73] Assignee: Fleissner GmbH & Co. Maschienefabrik, Egelsbach, Germany

[21] Appl. No.: 806,673

[22] Filed: Feb. 26, 1997

[30] Foreign Application Priority Data

Jul. 8, 1996 [DE] Germany ..... 196 27 256.4

[51] Int. Cl.[6] ..... D04H 1/46

[52] U.S. Cl. ..... 28/104; 28/105

[58] Field of Search ..... 28/103, 104, 105, 28/106, 107, 167; 68/204, 205 R

[56] References Cited

U.S. PATENT DOCUMENTS

| | | | |
|---|---|---|---|
| 3,150,416 | 9/1964 | Such | 28/106 |
| 3,508,308 | 4/1970 | Bunting, Jr. et al. | 28/104 |
| 3,747,161 | 7/1973 | Kalwaites . | |
| 3,837,046 | 9/1974 | Kalwaites | 28/105 |
| 4,297,404 | 10/1981 | Nguyen | 28/105 |
| 4,879,170 | 11/1989 | Radwanski et al. . | |
| 4,880,168 | 11/1989 | Randall, Jr. et al. . | |
| 4,931,355 | 6/1990 | Radwanski et al. . | |
| 4,967,456 | 11/1990 | Sternlieb et al. . | |
| 5,026,587 | 6/1991 | Austin et al. . | |
| 5,136,761 | 8/1992 | Sternlieb et al. . | |
| 5,153,056 | 10/1992 | Groshens | 28/103 |
| 5,253,397 | 10/1993 | Neveu et al. | 28/105 |
| 5,290,628 | 3/1994 | Lim et al. | 28/104 |
| 5,414,914 | 5/1995 | Suzuki et al. . | |
| 5,459,912 | 10/1995 | Oathout | 28/104 |
| 5,533,242 | 7/1996 | Profe . | |

FOREIGN PATENT DOCUMENTS

96/27040 9/1996 WIPO .

*Primary Examiner*—Amy B. Vanatta

*Attorney, Agent, or Firm*—Antonelli, Terry, Stout, & Kraus LLP

[57] ABSTRACT

Multiple needling with web guidance on alternate sides is achieved. Either an endless belt and/or a drum performs a carrying function, the belt or drum being arranged so that the fiber web can be associated meanderwise with the other side of a nozzle beam in each case. Transfer from one transport device or unit to another takes place by constant, positive, and non-stretching support of the fiber web, which is sensitive to being stretched.

27 Claims, 7 Drawing Sheets

METHOD AND DEVICE FOR HYDRODYNAMIC ENTANGLEMENT OF THE FIBERS OF A FIBER WEB

FIELD OF INVENTION

This invention relates to a method for hydrodynamic entanglement or needling, preferably for binder-free compaction, of fibers of a fiber web, especially a nonwoven fiber web, composed of natural and/or synthetic fibers of any type, wherein the fibers of the fiber web are entangled and compacted with one another by a plurality of water streams or jets applied at high pressure, with a large number of the water streams or jets striking the fiber web not only in succession but also several times on alternate sides of the web for optimum twisting of the fibers on the top and bottom of the fiber web and with the fiber web being guided on a meanderwise path.

BACKGROUND OF INVENTION

A method of hydrodynamic compaction is known, for example, from "Taschenbuch fur die Textilindustrie" (Handbook of the Textile Industry), 1991, Verlag Schiele & Schon GmbH, Berlin, pages 416–440, especially FIG. 6 on page 423. It is clearly evident from this article by Dr. J. Hendler that the result of the hydrodynamic compaction depends on the number of processing changes; in other words, on alternate exposure to the water streams. Various devices can be used to implement this principle. An important feature is the meanderwise guidance of the web of goods with each side of the fiber web alternately being on top and exposed to the water streams. When a plurality of needling drums is mounted in a line side-by-side and the needling nozzle beams are mounted above the drums, costly guidance for the web of goods is required to conduct the meanderwise guidance of the fiber web. It is better to have the drums wrapped meanderwise by the fiber web immediately after one another and for the needling nozzle beams to be associated alternately with the tops and bottoms of the drums.

The fiber web is very prone to warping in the lengthwise direction before it is finally compacted. Since the hydrodynamic needling must be performed on a belt that is permeable to water or a drum of this type must also be used to carry away the water, the fiber web is pressed into the structure of the belt or the like. When the fiber web is passed from one drum to the next, a lengthwise pull or tension occurs and this warps the fiber web. This disadvantage also exists when the separating process is reinforced by compressed air coming from the feed drum or by suction from the receiving drum. The drums must also be located very close together for direct transfer of the very thin fleece; in other words, the drums must have a precise rotational accuracy and must maintain it. This kind of drum is very expensive to manufacture and it is not certain that the rotational accuracy will remain unchanged during use.

SUMMARY OF THE INVENTION

The goal of the invention is to develop a method and a device with which a fiber web can be water-needled, said web not being exposed to any lengthwise tension during processing, in other words, the web can be processed in a tension-free manner and can be water-needled.

Taking its departure from the method of the known type heretofore described, the goal of the invention is achieved in a method wherein the fiber web, especially a fleece (nonwoven web), during its transport beneath the impacting liquid streams and during alternation of the processing surface, is guided continuously and positively, without stretching and with continuous support. Advantageously, this is possible when the web is supported and carried by a traveling endless belt, alternating the surface of the fiber web that rests on a support.

The present invention is also directed to a device for hydrodynamic entanglement, preferably for binder-free compaction of the fibers of a fiber web made of natural and/or synthetic fibers of any kind, said device comprising means for transporting the fiber web along a meandering path, a plurality of nozzle beams that extend transversely over the width of the fiber web at selected parts of the meandering path, said beams having nozzle openings directed toward the fiber web through which water jets out against the fiber web at high pressure to twist the fibers in the web together, a plurality of the nozzle beams being arranged sequentially and alternating several times in their positions relative to the fiber web for optimum twisting of the fibers on the top and bottom of the fiber web; the plurality of nozzle beams forming needling units arranged sequentially in a direction of travel of the fiber web so that the fiber web is subjected on both sides to the water jets while being guided meanderwisely. In order to achieve the stated goal, the fiber web is guided continuously and positively during its transport through and between the individual needling units on transporting means, and is supported on one side at all times, especially when changing a processing side, i.e. a side subjected to the water jets, without stretching. The fiber web can no longer warp during its transition from one needling unit to another.

If it is desired to perform needling with the water jets several times on alternate sides, a plurality of endless belts and associated drums or rolls must be provided, located sequentially in the transport direction of the fiber web. It is then advantageous to have a deflecting roll of the next endless belt, running at the same speed at this point, associated directly with each respective endless belt, and for this deflecting roll to be a receiving drum. The receiving drum then should be located at a tangent against the endless belt ahead of it, better yet pressed against the endless belt located ahead of it, so that it dips into the plane of the stretched endless belt. If the transfer is assisted by compressed air and/or by suction from the receiving endless belt or drum, problem-free transport of the fiber web through the entire needling device is guaranteed in every case.

Needling of a fiber web lying on a screen belt is more effective than on the drum, because the multilayered material for producing the drum jacket offers more resistance to the water streams. In addition, the water that penetrates the fiber web when the fiber web is needled can be carried away more effectively below an endless belt and drawn off during predrying at the end of the needling process. Of course, the energy aspect must be considered as well, since greater resistance on a drum requires more energy to overcome in order to achieve the same result. Depending on which version of the supporting surface for the fiber web is desired, for other reasons, the solution to the stated goal according to the invention is possible in any event. Either all of the receiving rolls or drums are wrapped by an endless belt, or only some of them. The primary requirement is that transfer to the next transport element or unit must be supported.

BRIEF DESCRIPTION OF THE DRAWINGS

Reference will now be made to the accompanying figures of drawings wherein several embodiments of the invention are shown.

Figure 1:
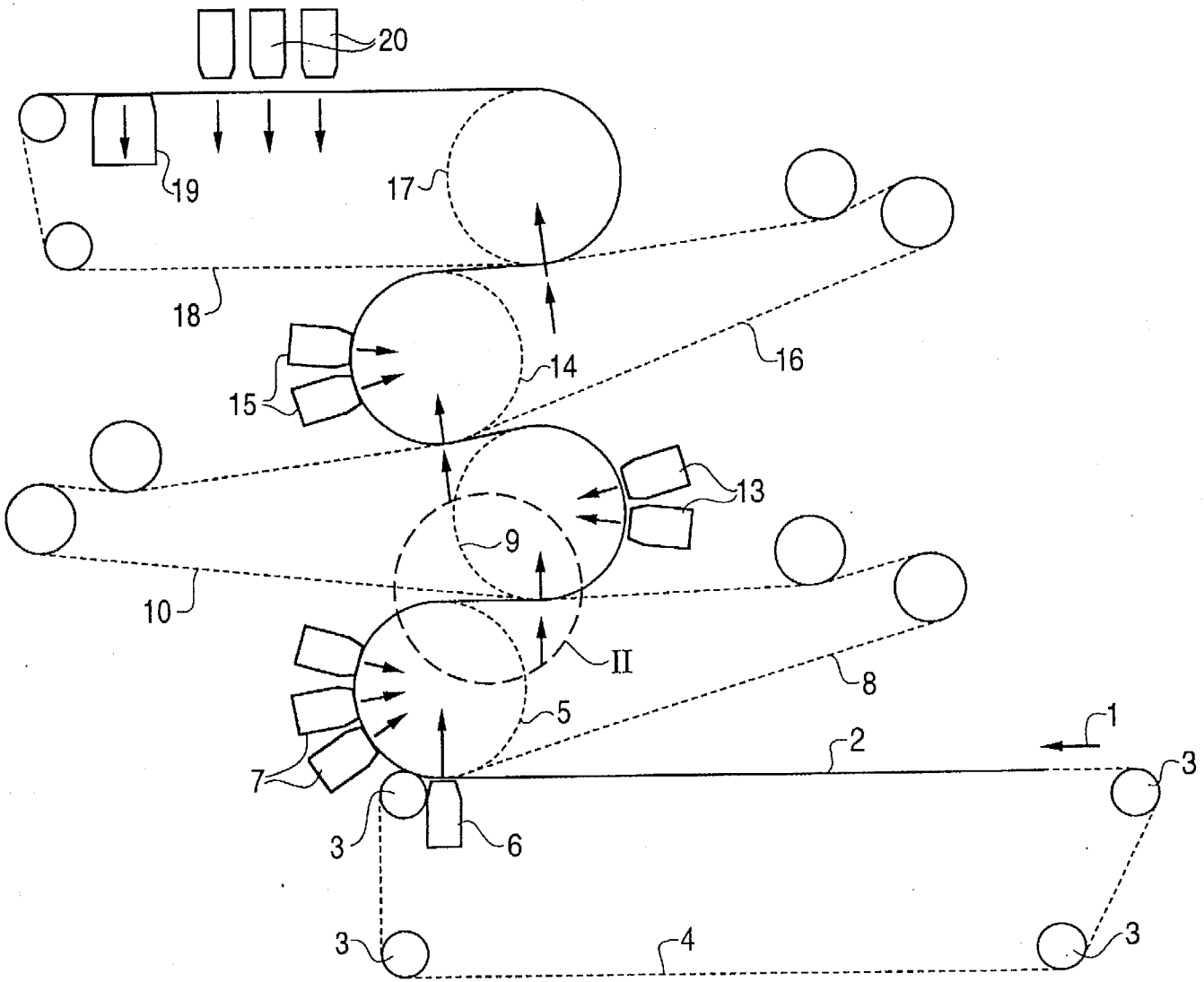
FIG. 1 is a schematic view of alternate quadruple needling, with triple needling on each perforated drum and the last one a perforated endless belt.

For the sake of clarity, in the embodiments shown, the needling drums or only the receiving drums are located above one another and have the same diameter. Other arrangements might be more advantageous. Also, unless otherwise indicated, all drums and endless belts are perforated, i.e. the drums include screen and sieve drums and the belts may be formed of screens or other perforated belt material. In any case, as shown in FIG. 1, the fiber web 2 coming from a carding machine, not shown, runs always in the direction of arrow 1, onto endless belt 4 that is tensioned and guided by four reversing rolls 3. At the end of the top run of the belt, a receiving drum 5 is located above the belt, said drum not only being located at a tangent to the endless belt 4, but also dipping into the plane of endless belt 4, guided with tension. This ensures a reliable, warp-free transfer of the fiber web from the belt. Prior to transfer, the fiber web is merely wetted by a nozzle beam 6 located near the endless belt 4. Receiving drum 5 is also wrapped by an endless belt 8 whose bottom run slowly compresses the web arriving in large quantities from belt 4 to an increasing degree and guides it into the transfer gap at nozzle beam 6.

The first needling takes place at receiving drum 5, in this case with three nozzle beams 7. Receiving drum 5 is wrapped by an endless belt 8 that guarantees primarily the transport from receiving drum 5 to the next superjacent drum. This drum is likewise wrapped by an endless belt 10, with said drum being not only a reversing drum for the endless belt but also simultaneously acting as a receiving drum 9. Receiving drum 9 likewise dips into a plane of the endless belt 8, guided with tension, so that the transfer of fiber web 2 for the second needling, to be performed on the other side, can be performed without warping.

Figure 2:
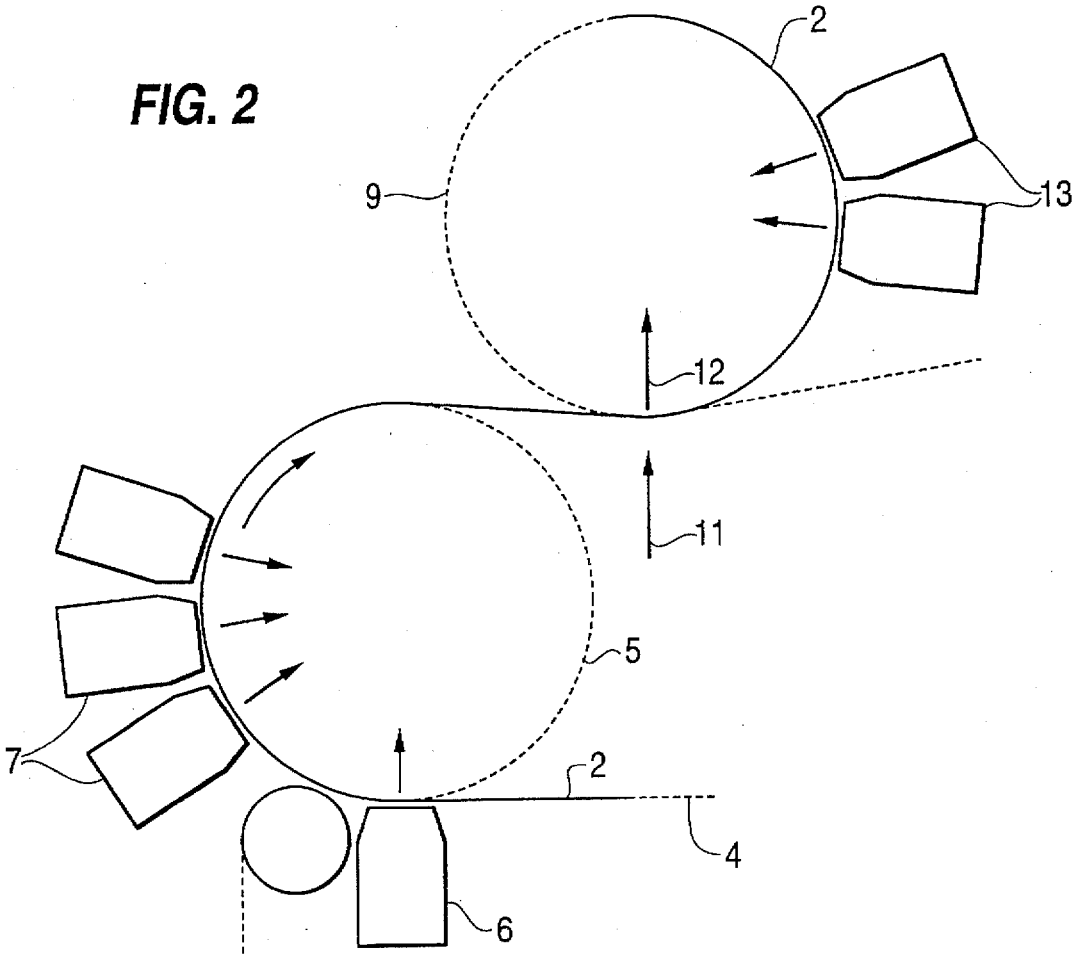
FIG. 2 shows an enlarged detail II according to a part of FIG. 1.

Detail II in FIG. 2 shows the arrangement of receiving drums 5 and 9. At the location of arrows 11, 12, exactly where the transfer of fiber web 2 from belt 4 to belt 10 takes place, receiving drum 9 is pressed against endless belt 4 and dips into belt 4 to deflect the latter slightly. Arrow 11 is intended to show reinforcement of the separation process of fiber web 2 from belt 4 by compressed air and arrow 12 is intended to show reinforcement of the transfer of fiber web 2 endless belt 10 by the suction generated there. This also applies to similar arrows at the other transfer points.

The second needling on receiving drum 9 now takes place on alternate sides by means of the associated nozzle beams 13, of which only two are shown here. Other versions are possible. This is followed by receiving drum 14 with nozzle beam 15 and receiving drum 17. Each of receiving drums 14, 17 is wrapped by an endless belt 16 or 18 so that the desired direct slip-free transfer of fiber web 2 can be accomplished by dipping the respective receiving drum into the plane of the associated endless belt. The transfer can be reinforced by compressed air 11 and/or suction 12. The last, fourth needling by nozzle beam 20 is not performed on receiving drum 17 but on an endless belt 18, followed by high-powered suction 19 in order to bring the completely needled fiber web 2 as dry as possible into the dryer, not shown, that follows.

Figure 3:
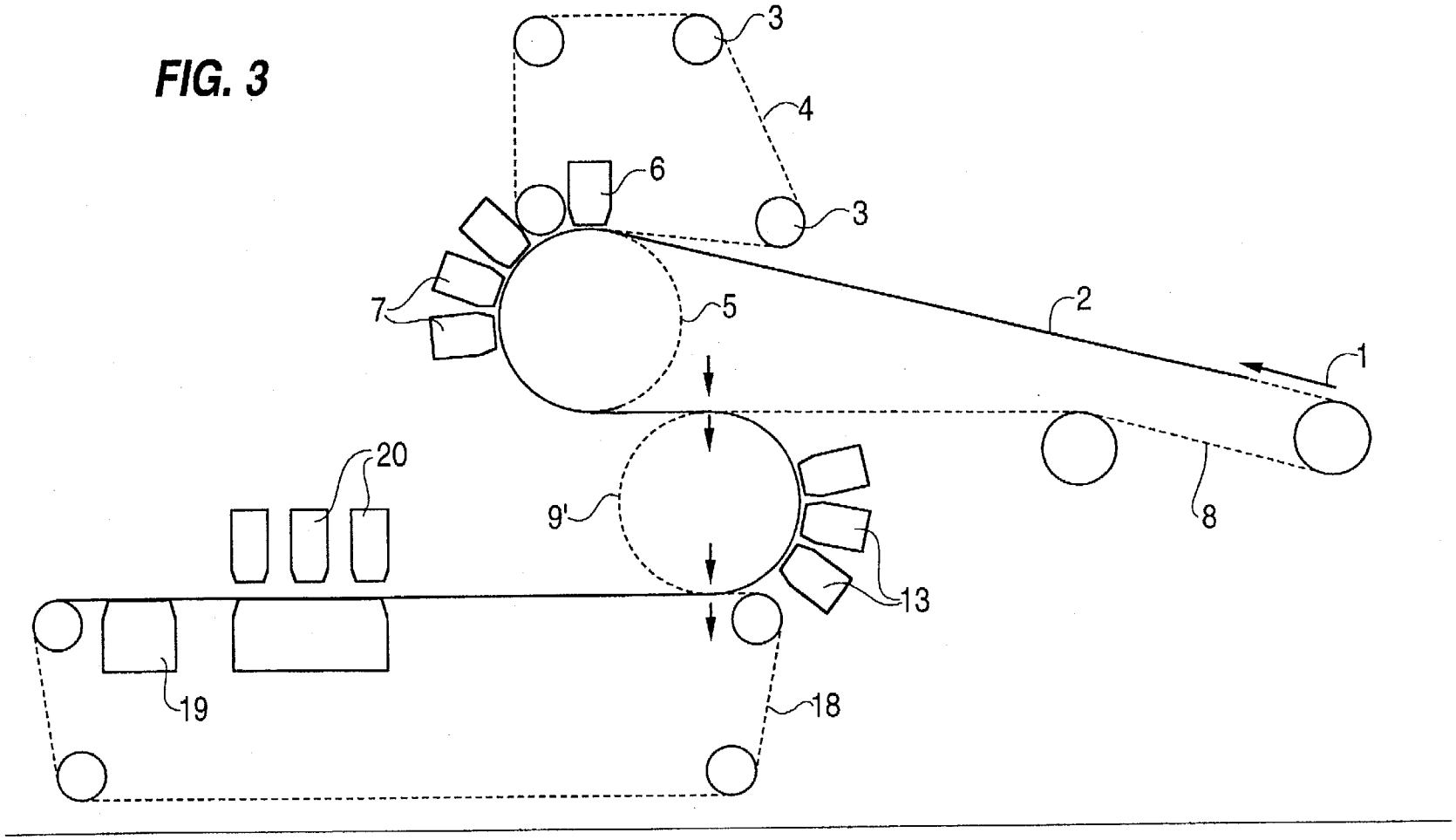
FIG. 3 shows a schematic view of an arrangement similar to that according to FIG. 1 with triple needling, in which the second drum, does not have an endless belt wrapped around it.
Figure 4:
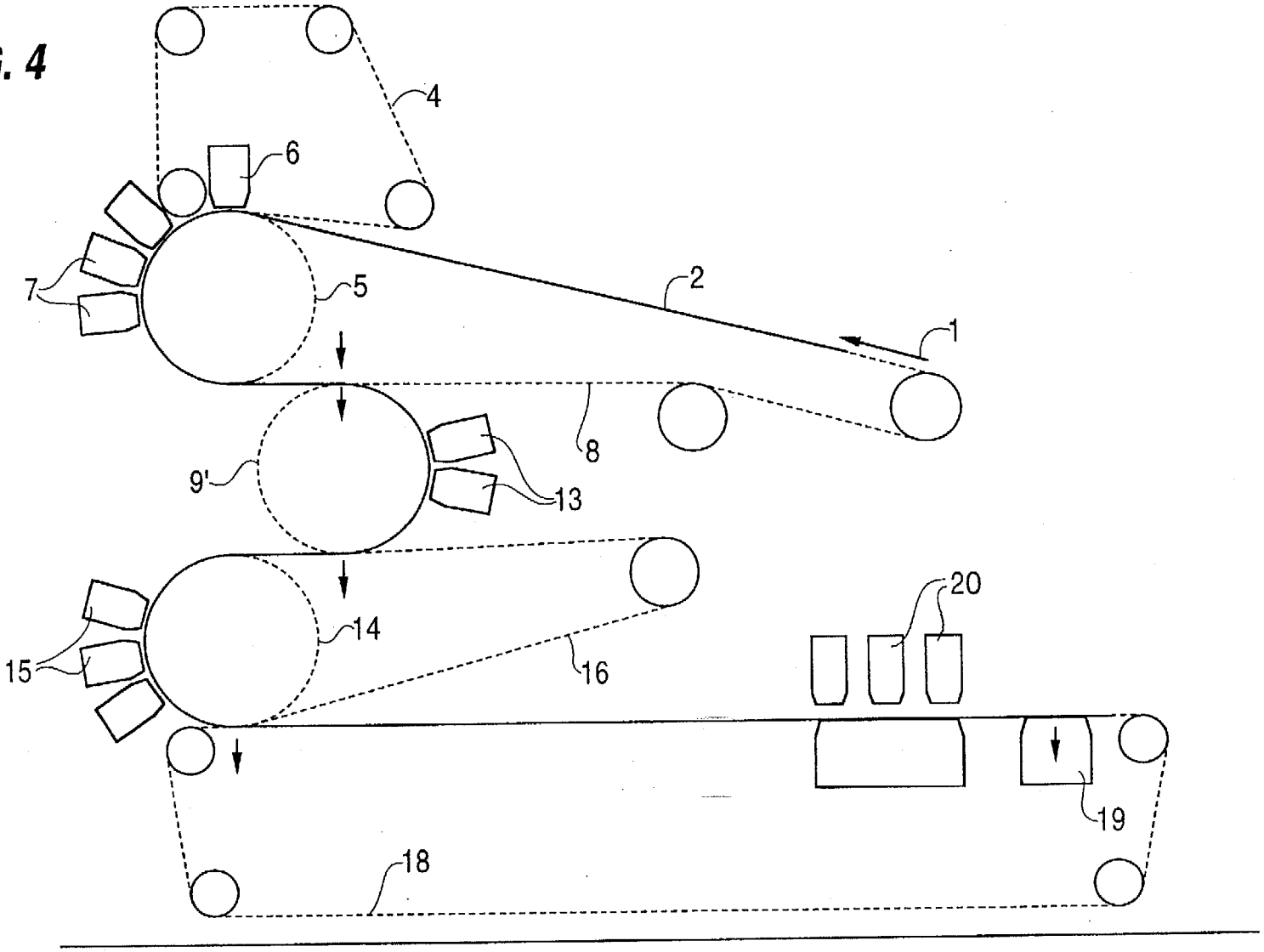
FIG. 4 is a schematic view of an embodiment similar to the embodiment of FIG. 3 with alternative quadruple needling in which the inlet and outlet are located on the same side.
Figure 5:
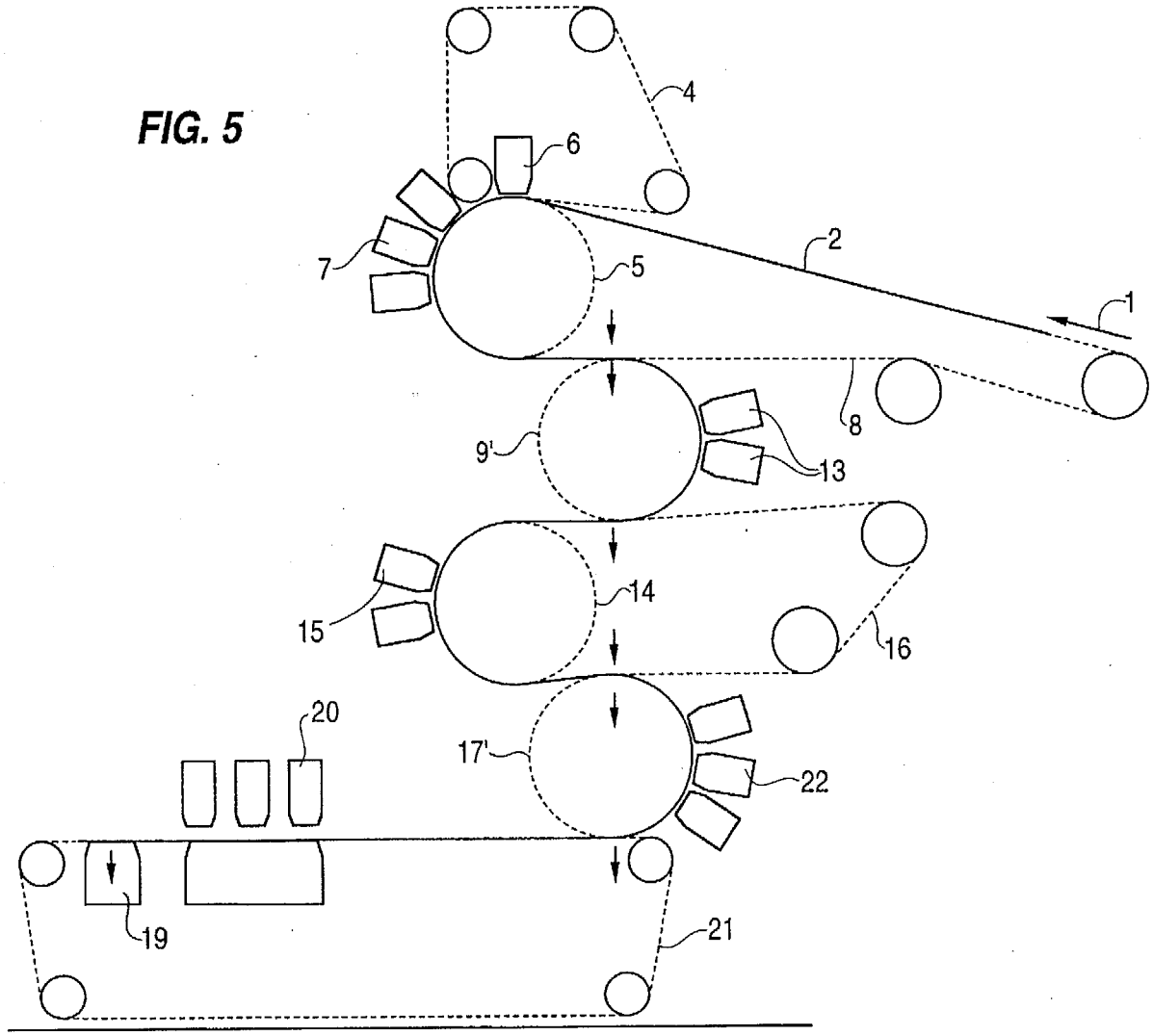
FIG. 5 is a schematic view of an embodiment similar to the embodiment in FIG. 3 with alternate quintuplicate needling.

The other embodiments are similar to FIG. 1 and similar elements are given the same reference numbers where appropriate. The embodiment according to FIG. 3 shows a version of needling that not only takes place three times in this case, but the web is guided from top to bottom and second receiving drum 9' is not wrapped by an endless belt. This belt, which was still necessary in the embodiment shown in FIG. 1, can be eliminated here, since receiving drum 9' dips or extends into the planes of both endless belt 4 and endless belt 18. The same is true of the embodiment shown in FIG. 4, in which receiving drum 14 with endless belt 16 abuts receiving drum 9' for quadruple needling, followed by final endless belt 18 as shown in FIG. 1, with needling on the belt. The needled fiber web 2 then travels in the direction opposite to arrow 1. This possibility is changed in the embodiment shown in FIG. 5 by the additional provision of a receiving drum 17' with nozzle beam 22 which again operates according to the invention without a circulating endless belt. The same principle that applies to receiving drum 9' applies here. This is followed, for a possible required fifth needling, by endless belt 21 with final needling by beam 20 and suction 19.

Figure 6:
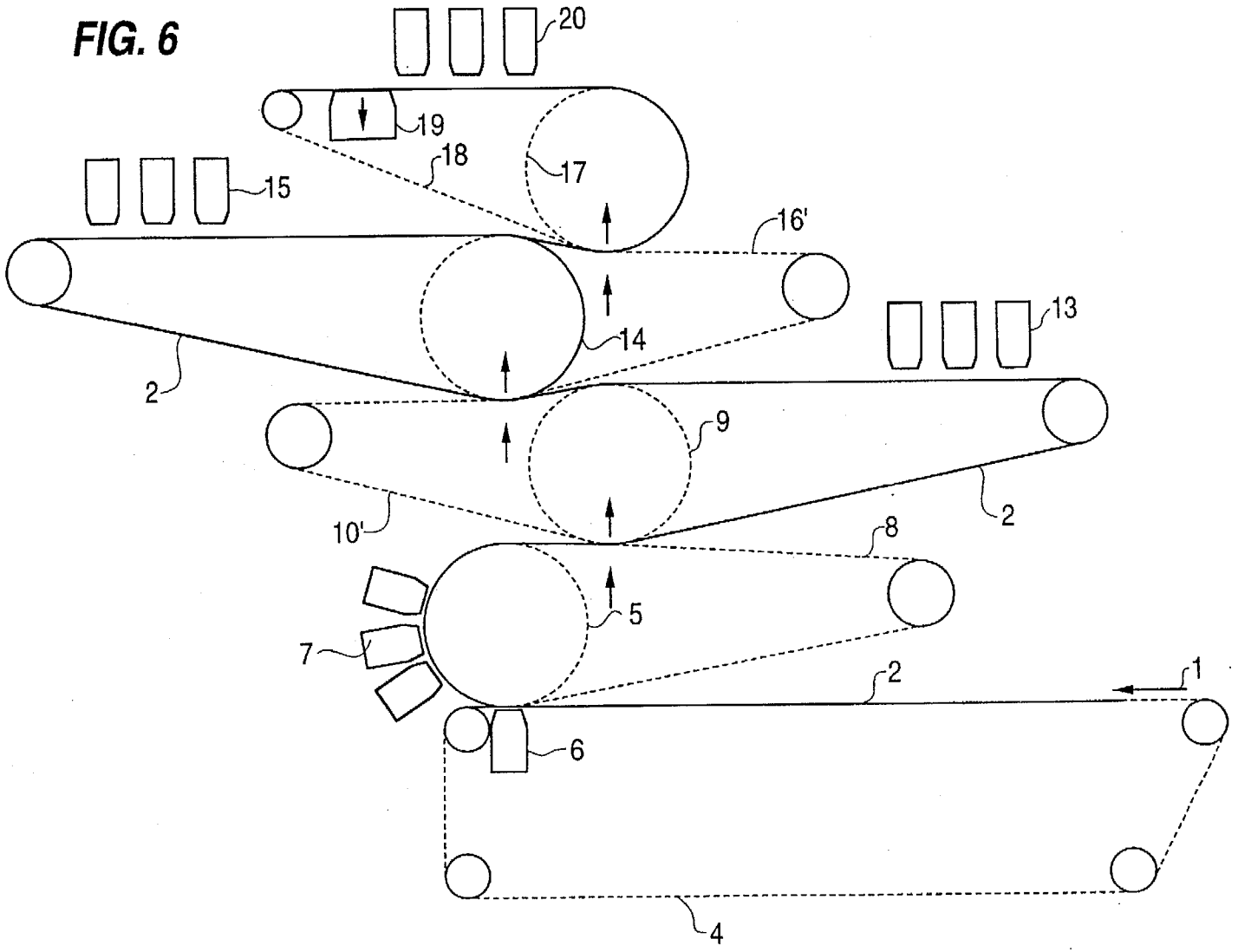
FIG. 6 shows an embodiment using a quadruple needling, in which needling takes place at three successive points on endless belts.

The embodiment shown in FIG. 6 is a version in which only a small amount of energy need be used for needling because the needling stations are provided primarily on the endless belts. Exactly as in the embodiment according to FIG. 1, fiber web 2 runs first over endless belt 4 to receiving drum 5, where the first needling with nozzle beam 7 takes place. Then the fiber web, beginning at receiving drum 9, travels on the underside of endless belt 10' extending to the right, and is then deflected upward and needled by nozzle beam 13 on belt 10'. Endless belt 10' also extends to the left, where it contacts receiving drum 14 or the latter dips into the plane of endless belt 10'. In addition, this drum 14 is wrapped on both sides by an endless belt 16' on whose lower run it is initially guided upward once again to reach nozzle beam 15 located above belt 16'. The final needling is then also performed on belt 18 once again as in FIG. 1.

Figure 7:
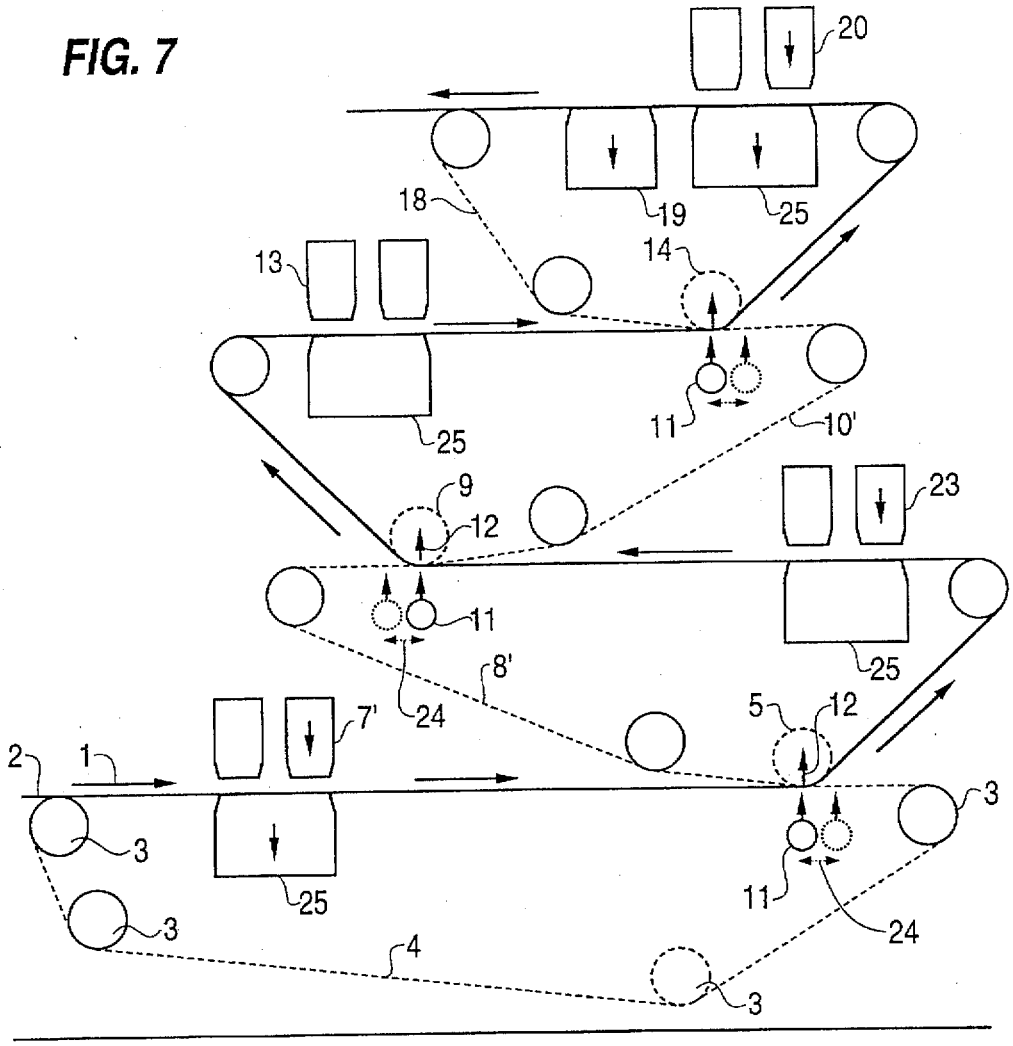
FIG. 7 likewise shows an embodiment using a quadruple needling but with four endless belts arranged in parallel and above one another, each being subjected to water needling directed vertically downward.

The fiber web is likewise guided from bottom to top in FIG. 7, but in this embodiment only endless belts 4, 8', 10' and 18 are provided for needling, said belts supporting fiber web 2, and on which needling is performed on alternate sides. The top run of each endless belts 4, 8', 10' and 18 is aligned horizontally so that nozzle beams 7', 23, 13 and 20 operate from top to bottom, therefore, for example, vertically downward. In order to have sufficient space available for mounting nozzle beams 7', 23 and 13, endless belts 8', 10' and 18, arranged parallel above one another, are each advanced horizontally in the transport direction. A suction channel 25 is located below each of the nozzle beams.

The receiving drums 5, 9, 14, each of which is located tangentially with respect to endless belts 4, 8' and 10', are made permeable to air, although no needling takes place on them as is partially the case in the previous embodiment 1–5. Making these endless belt deflecting rolls perforated, as in the embodiment shown in FIG. 2, has the advantage that the transfer of fiber web 2 with supporting air from nozzles 11 and/or suction from receiving drums 5, 9, 14 can be influenced. Water can also be sprayed from nozzles 11 against the endless belt supporting fiber web 2. In such cases, perforation of the receiving drum may be eliminated. The important thing in this regard is that the fiber web, previously needled and thus pressed against the endless belt, comes loose from the endless belt and is delivered to the next endless belt without warping. In order to influence further this transfer of fiber web 2 to receiving drums 5, 9, 14, a plurality of nozzles such as air nozzles 11 can be directed in this area against the supporting endless belt or only one nozzle can be mounted displaceably. This arrangement is indicated by reference numeral 24.

What is claimed is:

1. A device for hydrodynamic entanglement or needling of the fibers of a fiber web made of at least one of natural and synthetic fibers, said device comprising means for transporting the fiber web along a meandering path, a plurality of nozzle beams each of which extends transversely over the width of the fiber web, said beams having nozzle openings from which water streams under high pressure are directed against the fiber web to twist the fibers, the plurality of nozzle beams being arranged in spaced apart locations along the meandering path and on alternate sides of the fiber web, for optimum twisting of the fibers on the top and bottom of the fiber web, the plurality of nozzle beams being separated to form needling units arranged sequentially in a direction of travel of the web so that the fiber web, guided meanderwise, is exposed to the water streams on both sides, wherein said transporting means guides the fiber web positively without interruption, with support on one side during transport through individual needling units and with continuous support when changing the side of the web to be needled, without stretching of the fiber web.

2. A device according to claim 1, wherein said transporting means includes a plurality of transporting units for supporting said fiber web along the meandering path, one transporting unit comprising a plurality of deflecting rolls around which an endless belt is guided and other transporting units comprising at least one endless belt located in the transport direction of the web, a deflecting roll of an endless belt of a successive transporting unit, running at the same speed as an endless belt of a preceding transporting unit, being directly associated with a respective endless belt of the preceding transporting unit, said deflecting roll comprising a receiving drum.

3. A device according to claim 2, wherein the receiving drum comprises an air-permeable, perforated drum.

4. A device according to claim 2 or 3, wherein the receiving drum is located tangentially with respect to a path of the previous endless belt.

5. A device according to claim 3, wherein the receiving drum is pressed against the previous endless belt and thus extends into a guide plane of the previous endless belt that is guided and stretched between two deflecting rolls associated with said previous endless belt.

6. A device according to claim 3, wherein the nozzle beams of a successive needling unit are associated with an endless belt arranged successively in the transport direction of the web.

7. A device according to claim 6, wherein a plurality of endless belts are guided in a needling area, aligned parallel to one another, and at least one nozzle beam of a needling unit associated with the needling area is directed vertically downward against the web on an endless belt.

8. A device according to claim 7, wherein at least two endless belts are arranged one above the other and are wrapped at least partially meanderwise by the fiber web, and each successive endless belt, located above, is advanced horizontally in the transport direction and is thus arranged so that room is provided for mounting at least one nozzle beam of a previous endless belt above a level of the successive endless belt.

9. A device according to claim 2, wherein nozzle beams of a successive needling unit in the transport direction of the web are associated with receiving drums.

10. A device according to claim 2, wherein only one drum for transporting the web without an endless belt wrapped around it is provided between two endless belts and the two endless belts are mounted at a tangent to the one drum, and the one drum dips into guide planes of the two endless belts.

11. A device according to claim 2, wherein a final needling unit is associated with an endless belt and a suction beam is located beneath the endless belt and ganged behind it.

12. A device according to claim 2, wherein there is provided, along a receiving line, of the fiber web between an endless belt and the receiving drum or vice versa, at least one nozzle supplied with water or air, aimed against a surface of the fiber web to be separated from a support, along the meandering path, and in the form of a slot.

13. A device according to claim 12, wherein the nozzle is mounted displaceably and/or pivotably parallel to the endless belt relative to the receiving drum or the receiving line.

14. A device according to claim 2, wherein said device further comprises a slot-shaped suction duct for carrying away water and/or air, said suction duct being effective in the transport direction, facing a surface of the fiber web to be adjacent a support further along the meandering path, and being located along a receiving line of the fiber web between the endless belt and the receiving drum or vice versa.

15. A device according to claim 14, wherein the suction duct is located in an air-permeable receiving drum and acts on the fiber web through the wall of the receiving drum.

16. A device according to claim 1, wherein each needling unit comprises at least one nozzle beam directing water streams against the fiber web.

17. A device according to claim 1, wherein the transporting means includes at least two drums on which needling is effected by at least one nozzle beam and wherein the fiber web is a nonwoven fleece made up of loosely laid short fibers, staple fibers and/or endless fibers.

18. A device according to claim 8, wherein said at least two endless belts comprise at least four endless belts arranged one above the other and wrapped at least partially meanderwise by the fiber web.

19. A device according to claim 4, wherein said receiving drum is a drum on which the web is subjected to needling by the water streams.

20. A method for hydrodynamic entanglement or needling of the fibers of a fiber web, wherein the fibers of the fiber web are twisted together by means of a plurality of water streams directed against the web under high pressure, the water streams striking the fiber web for twisting together of the fibers, comprising the steps of:

guiding the fiber web along a meanderwise path; and while the fiber web is being guided along the meanderwise path, (1) directing first water streams against one of the top surface and the bottom surface of the fiber web to subject the fiber web to first needling under impact of the first water streams, the other of the top and bottom surfaces being supported by a support adjacent thereto during the first needling;

(2) removing the support adjacent the other of the top and bottom surfaces, and providing a support adjacent said one of the top and bottom surfaces; and (3) with said support adjacent said one of the top and bottom surfaces, directing second water streams against the other of the top and bottom surfaces of the fiber web to subject the fiber web to second needling under impact of the second water streams;

wherein the fiber web is supported continuously during the steps of directing the first and second water streams and said removing and said providing the supports, such that the fiber web is guided continuously and positively without stretching and with support as the top and bottom surfaces of the web are subjected to the first and second water streams.

21. A method according to claim 20, including the further step, after the step of directing the second water streams, and while the fiber web is being guided along the meanderwise path, of (4) removing the support adjacent said one of the top and bottom surfaces and providing a support adjacent the other of the top and bottom surfaces, wherein the fiber web is supported continuously during steps (1)–(4).

22. A method according to claim 21, wherein the steps (1)–(4) are repeated at least once.

23. A method according to claim 20, wherein the fibers are selected from the group consisting of natural and synthetic fibers.

24. A method according to claim 20, wherein the fiber web is free of binders.

25. A method according to claim 20, wherein the steps (1)–(3) are repeated at least once, and the top and bottom surfaces alternately have water streams directed thereagainst.

26. A method according to claim 20, wherein when removing the support adjacent the other of the top and bottom surfaces and providing the support adjacent the one of the top and bottom surfaces, the fiber web is supported and carried by an endless belt travelling with the web.

27. A method according to claim 20, wherein the fiber web is supported continuously by at least one of the support adjacent the one of the top and bottom surfaces and the support adjacent the other of the top and bottom surfaces during the steps (1)–(3).

* * * * *